United States Patent [19]

Yoshida

[11] 4,117,811

[45] Oct. 3, 1978

[54] THROTTLE VALVE POSITIONER

[75] Inventor: Toshiro Yoshida, Toyota, Japan

[73] Assignee: Toyota Jidosha Kogyo K.K., Japan

[21] Appl. No.: 672,635

[22] Filed: Apr. 1, 1976

[30] Foreign Application Priority Data

Aug. 26, 1975 [JP] Japan ..... 50-103346

[51] Int. Cl.[2] ..... F02D 11/08

[52] U.S. Cl. ..... 123/103 R; 123/103 B; 123/103 E

[58] Field of Search ..... 123/103 E, 97 B, 103 R, 123/103 B; 137/DIG. 8

[56] References Cited

U.S. PATENT DOCUMENTS

| | | | |
|---|---|---|---|
| 1,515,648 | 11/1924 | Arnold | 137/DIG. 8 |
| 2,005,262 | 6/1935 | Liverance, Jr. | 123/103 E |
| 2,169,683 | 8/1939 | Dunham et al. | 137/DIG. 8 |
| 2,205,458 | 6/1940 | Ball | 123/103 E |
| 2,592,375 | 4/1952 | Ball | 123/103 E |
| 2,749,938 | 6/1956 | Thomas | 123/103 E |
| 2,985,196 | 5/1961 | Brunner | 123/103 E |
| 2,993,484 | 7/1961 | Gallman | 123/103 R |
| 3,916,854 | 11/1975 | Barton et al. | 123/103 E |
| 3,955,364 | 5/1976 | Lewis | 123/97 B |
| 3,996,904 | 12/1976 | Kobuki et al. | 123/103 R |

*Primary Examiner*—Irwin C. Cohen
*Attorney, Agent, or Firm*—Koda and Androlia

[57] ABSTRACT

A vacuum control valve is actuated by a vacuum created in the intake passage of an internal combustion engine for directly controlling on-off of a vacuum circuit thereby energizing or deenergizing a throttle valve positioner diaphragm device which controls motion of the throttle valve so as not to be abruptly urged in a closing direction. A first vacuum bleed port is connected by a conduit to a diaphragm chamber in the throttle valve positioner diaphragm device through an orifice and is located downstream relative to the throttle valve during rotation of the engine at an idling speed. A rod is connected to the diaphragm in the throttle valve positioner diaphragm device to restrict swinging movement of the throttle valve in the closing direction. The vacuum control valve is disposed in a conduit branched from the conduit connecting the first vacuum bleed port to the orifice and has a port which can communicate with the atmosphere. The vacuum control valve is actuated by a vacuum applied from a second vacuum bleed port located always downstream relative to the throttle valve. The vacuum control valve permits admission of air at the atmospheric pressure into the conduit leading to the diaphragm chamber in the throttle valve positioner diaphragm device thereby inhibiting swinging movement of the throttle valve in the closing direction, when the absolute value of the vacuum in the intake passage exceeds a predetermined setting.

2 Claims, 4 Drawing Figures

THROTTLE VALVE POSITIONER

BACKGROUND OF THE INVENTION

1. Field of the Invention

This invention relates to a throttle valve positioner which prevents abrupt closure of the throttle valve in the carburetor in internal combustion engines for vehicles such as automobiles and controls the throttle valve opening depending on the vacuum created in the intake passage supplying the fuel-air mixture to the engine.

2. Description of the Prior Art

Various types of throttle valve positioners have been proposed hitherto for controlling the opening of the throttle valve in the carburetor in internal combustion engines. In a prior art throttle valve positioner of one type, a diaphragm chamber formed in the throttle valve positioner body is merely connected to a vacuum bleed port located to open in the vicinity of the throttle valve disposed in the intake passage of an engine. In an engine equipped with a prior art throttle valve positioner of another type, a pulse signal generated by a speed sensor associated with the speed meter is applied to a computer which generates an output voltage when the vehicle speed exceeds a predetermined setting value, thereby energizing an electromagnetic valve (a vacuum switching valve) provided for switching the vacuum in the intake passage of the engine. The electromagnetic valve thus energized establishes a path of communication between a diaphragm chamber in the throttle valve positioner body and the atmosphere thereby energizing the throttle valve positioner. On the other hand, when the vehicle speed is reduced to a value lower than the predetermined setting, no output voltage appears from the computer to restore the electromagnetic valve to the original state or deenergized state. Consequently, the vacuum in the intake passage of the engine acts upon the diaphragm in the diaphragm chamber of the throttle valve positioner body to deenergize the throttle valve positioner.

However, the prior art throttle valve positioner of the former type has been defective in that the throttle valve tends to be abruptly closed in spite of the fact that the speed of the vehicle is still high as in the case of impartation of the engine brakes to the vehicle. The prior art throttle valve positioner of the latter type has also been defective in that the use of the elements including the speed sensor, computer and electromagnetic valve results inevitably in high costs, although it can satisfactorily reliably operate for the throttle valve control.

SUMMARY OF THE INVENTION

It is an object of the present invention to provide a novel and improved throttle valve positioner having a diaphragm chamber formed in the throttle valve positioner diaphragm device substantially similar to a known dash pot structure and connected by a conduit to a vacuum bleed port located to open into the intake passage of an internal combustion engine, in which a vacuum control valve or on-off valve adapted to be actuated by a vacuum created in the intake passage is connected to the conduit for inhibiting transmission of the vacuum from the vacuum bleed port to the diaphragm chamber when the absolute value of the vacuum in the intake passage is greater than a predetermined setting, so as to eliminate the tendency of giving a very uncomfortable feeling of drive to the driver, which tendency is frequently seen in a vehicle equipped with a prior art throttle valve positioner in the vehicle speed control system when the throttle valve positioner operates at a vehicle speed higher than a certain level at which the HC content of the engine exhaust gas is relatively low. Therefore, the throttle valve positioner according to the present invention is reliably energized during deceleration in a speed range in which the HC content in the engine exhaust gas is relatively high and the absolute value of the vacuum created in the intake passage is relatively large. On the other hand, the throttle valve positioner is reliably deenergized during deceleration in a speed range in which the HC content in the engine exhaust gas is relatively low and the absolute value of the vacuum created in the intake passage is relatively small. Thus, the chance of wasteful unnecessary energization of the throttle valve positioner can be reduced to a minimum.

Another object of the present invention is to provide a throttle valve positioner which is energized during deceleration in a high speed range in which the operation of the throttle valve positioner is not especially sensed by the driver, and which is deenergized during deceleration in a low speed range in which the operation of the throttle valve positioner may impart an irritating sensation to the driver, so that the driver can always drive the vehicle with a comfortable feeling.

Still another object of the present invention is to provide a throttle valve positioner which is simple in structure and can be manufactured at a low cost.

Yet another object of the present invention is to provide a throttle valve positioner in which a vacuum delay transmitting valve is disposed between the vacuum bleed port and the connection point of the vacuum control valve with the conduit, so that, when the control setting of the vacuum control valve is selected to be relatively low in relation to the vacuum appearing in the intake passage at an idling speed of the engine, the vacuum delay transmitting valve can act to delay the transmission of the vacuum to the throttle valve positioner thereby placing the throttle valve positioner in continuous operation even after the closure of the vacuum control valve. Thus, the desired cleaning of the engine exhaust gas can be more adequately achieved, and the throttle valve positioner can be smoothly energized and deenergized in response to the on-off of the vacuum control valve during deceleration.

The throttle valve positioner according to the present invention comprising the unique vacuum control valve is advantageous over a prior art mechanical throttle valve positioner not equipped with such vacuum control valve, in that the operating point need not be set to meet the longest deceleration mode which appears during deceleration of the vehicle running in the exhaust gas mode. The prior art mechanical throttle valve positioner has been defective in that, when the operating point is set to meet such long deceleration mode, the throttle valve positioner tends to be maintained in the energized state even after the vehicle running at a high speed is stopped within a relatively short distance as by abrupt impartation of the brakes. Such defect is obviated by the present invention. Further, the present invention obviates such a trouble that the operating time of the throttle valve positioner is extended due to reduction in the vacuum created in the intake passage when the vehicle is running on a high ground. Furthermore, the present invention is advantageous over the prior art mechanical throttle valve positioner not equipped with the vacuum control valve, in that the throttle valve positioner is not deenergized during impartation of the brakes over a long distance. Therefore, the catalyst used for the cleaning of the engine exhaust gas is not adversely affected in any way. With the arrangement of the throttle valve positioner provided with a vacuum delay transmitting valve illustrated in the second embodiment of the present invention, which comprises a pair of orifices and a check valve disposed in series with one of said orifices, said check valve permitting only the flow of fluid from the vacuum bleed port to the diaphragm chamber in the throttle valve positioner diaphragm device, the flow rate of fluid from the vacuum bleed port toward the diaphragm chamber of the throttle valve positioner diaphragm device is greater than that in the reverse direction, and thus the rate of transmission of the atmospheric pressure toward the vacuum bleed port is less than the rate of transmission of the vacuum from the vacuum bleed port toward the diaphragm chamber. Therefore, the technical effect is obtained in that the mixing ratio of fuel and air is subject to less change.

DESCRIPTION OF PRESENTLY PREFERRED EMBODIMENTS

Figure 1:
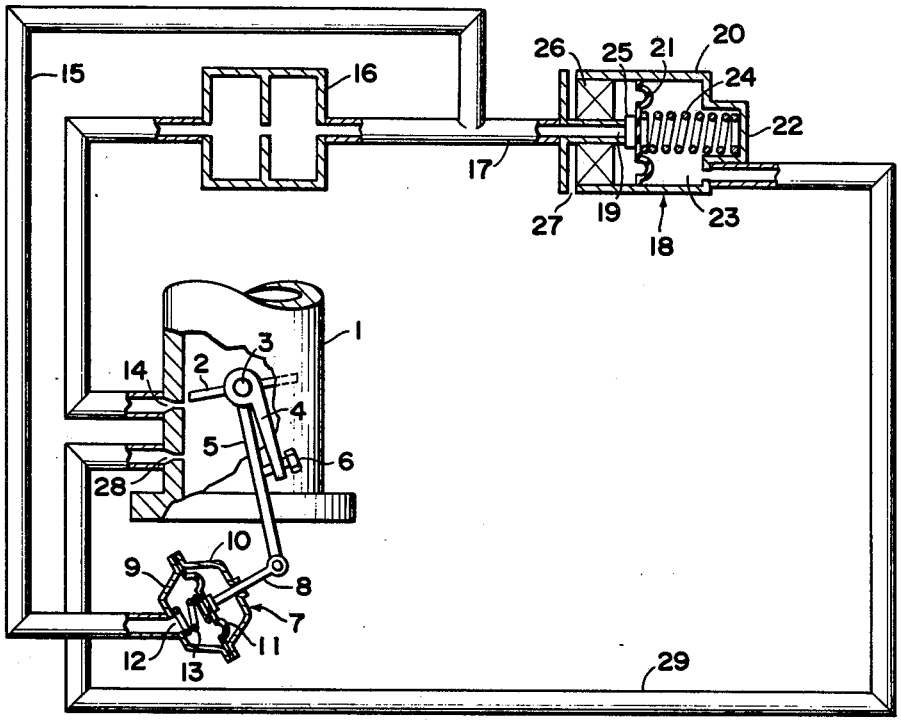
FIG. 1 is a partly sectional, schematic view showing the structure of a preferred embodiment of the throttle valve positioner according to the present invention when applied to an automobile engine.

The present invention will now be described in detail with reference to the accompanying drawings. In FIG. 1, there is shown a first preferred embodiment of the throttle valve positioner according to the present invention when applied to an automobile engine.

Referring to FIG. 1, a throttle valve 2 is swingably rigidly mounted on a throttle shaft 3 so as to be swingable within an intake passage 1 of a carburetor in an internal combustion engine of an automobile. One end portion of the throttle shaft 3 protrudes outwardly from the wall of the intake passage 1 to be firmly fixed to an associated portion of a throttle lever 4. One end of a throttle valve stopper 5 is also supported by this end of the throttle shaft 3 so as to be swingable therearound. An adjuster 6, which may be a screw, is retractably mounted on another portion of the throttle lever 4. One end of the adjuster 6 terminates opposite to a suitable portion of the throttle valve stopper 5 thereby restricting the swinging movement of the throttle lever 4 toward the stopper 5. The stopper 5 and adjuster 6 are so positioned that the adjuster 6 is engaged by the stopper 5 when the throttle valve 2 is swung to a position nearly close to the full closed position.

The throttle valve positioner diaphragm device generally designated by the reference numeral 7 is similar in structure to a known dash pot and includes a rod 8 which is pivoted at one or outer end thereof to the other end of the stopper 5. The throttle valve positioner diaphragm device 7 further comprises separatable halves 9 and 10 to provide a diaphragm device casing, and the other or inner end of the rod 8 is firmly fixed to the center of a diaphragm 11 held between the mating surfaces of these casing halves 9 and 10. the space defined between this diaphragm 11 and the casing half 9 located on the side remote from the outer end of the rod 8 provides a diaphragm chamber 12. A compression spring 13 is interposed between the casing half 9 and the diaphragm 11 within this diaphragm chamber 12 so as to normally urge the rod 8 in a direction in which the rod 8 protrudes from the casing half 10. The space defined between the diaphragm 11 and the casing half 10 is communicated with the atmosphere through an opening in which the rod 8 is loosely fitted.

A first vacuum bleed port or first throttle positioner port 14 is located to open into the intake passage 1 in the vicinity of the throttle valve 2. This first vacuum bleed port 14 is disposed in such a position that it is located downstream relative to the throttle valve 2 when the throttle valve 2 takes a position nearly close to the full closed position, that is, during rotation of the engine at an idling speed, and when the opening of the throttle valve 2 is set by the throttle valve positioner, while it is located upstream relative to the throttle valve 2 when the vehicle is running at a steady speed. This first vacuum bleed port 14 is connected by a conduit 15 to the diaphragm chamber 12 in the throttle valve positioner diaphragm device 7. A vacuum delay transmitting valve 16 comprising a conventional orifice is disposed midway of the conduit 15.

The conduit 15 leading from the diaphragm chamber 12 to the vacuum bleed port 14 through the vacuum delay transmitting valve 16 is connected at a suitable intermediate position between the diaphragm chamber 12 and the valve 16 to another conduit 17 which leads to an openably closed atmosphere communication port 19 of a vacuum control valve generally designated by the reference numeral 18.

The vacuum control valve 18 comprises a casing 20 which is closed at one end thereof, and a diaphragm 21 disposed substantially in the middle of the internal space of the casing 20. A diaphragm chamber 23 is defined between the diaphragm 21 and stepped portion 22 of the closed end of the casing 20, and a compression spring 24 is interposed between the diaphragm 21 and the stepped end portion 22 within the diaphragm chamber 23. A valve member 25 is mounted on the diaphragm 21 within the casing 20 on the side remote from the side having the spring 24. The spring 24 acts to normally urge the diaphragm 21, hence the valve member 25 in a direction in which the atmosphere communication port 19 is normally closed by the valve member 25. An air filter 26 of material such as sponge rubber is fitted in the open end of the casing 20 so that the space on the opposite side of the diaphragm chamber 23 can communicate with the atmosphere through an atmosphere communication opening 27. Therefore, the atmosphere communication port 19 communicates with the atmosphere when the valve member 25 is urged away from the closing engagement with the atmosphere communication port 19.

A second vacuum bleed port or second throttle positioner port 28 is located to open into the intake passage 1 at a position downstream relative to the first vacuum bleed port 14. Thus, a vacuum created in the intake passage 1 due to the operation of the engine (not shown) acts always upon this second vacuum bleed port 28.

This second vacuum bleed port 28 is connected by another conduit 29 to the diaphragm chamber 23 in the vacuum control valve 18.

Figure 2:
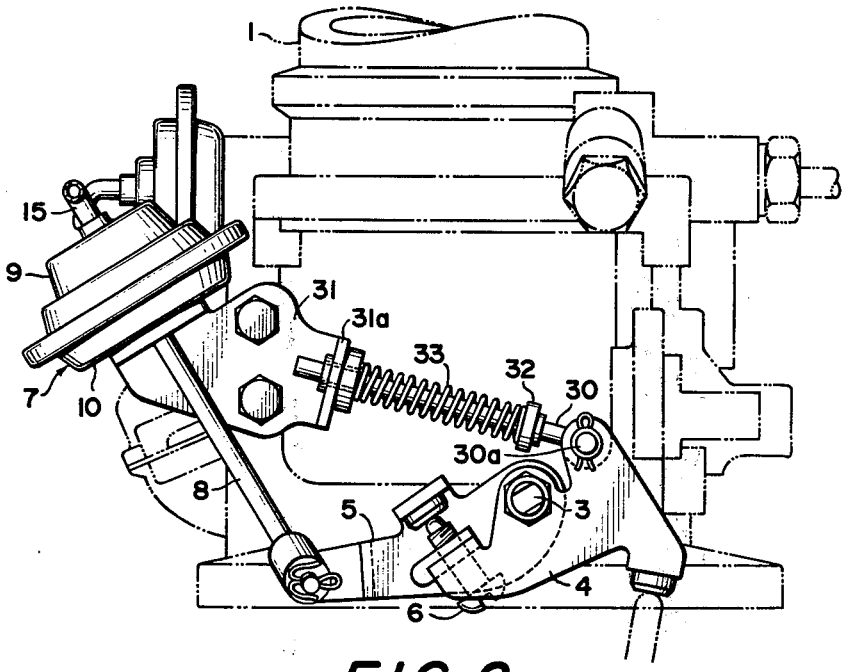
FIG. 2 is an enlarged schematic side elevational view of the positioner parts associated with the intake passage of the engine.

As shown in FIG. 2, a bent end portion 30*a* of a guide rod 30 is pivoted to the throttle lever 4, and the other end of this guide rod 30 is slidably supported in and passed through the corresponding opening of the bent portion 31*a* of a supporting member 31 fixed external to the intake passage 1. A spring engaging member 32 is firmly fixed to the guide rod 30 adjacent the end pivoted to the throttle lever 4, and a compression spring 33 is interposed between this spring engaging member 32 and the supporting member 31. Thus, the throttle lever 4 is normally urged to swing clockwise in FIG. 2 by the force of the spring 33 thereby normally passing the adjuster 6 pivotably mounted on the lever 4 against the throttle valve stopper 5.

Figure 3:
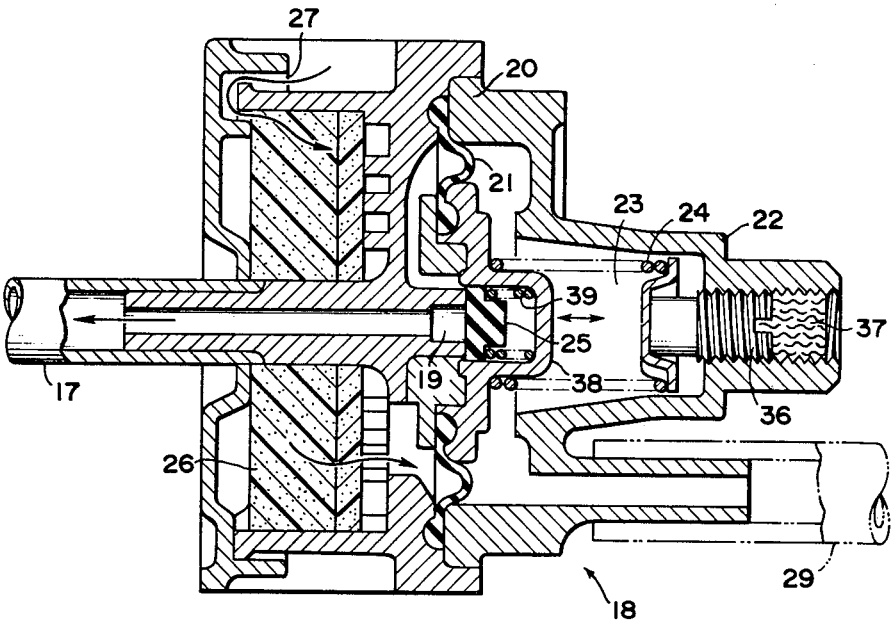
FIG. 3 is an enlarged sectional view of one form of the vacuum control valve preferably employed in the present invention.

FIG. 3 is an enlarged sectional view showing in detail the structure of the vacuum control valve 18. Referring to FIG. 3, an adjusting screw 36 is screwed into the stepped end portion 22 of the casing 20 to be advanced and retracted for adjusting the force imparted by the compression spring 24. A filler 37 such as sealant, grease or adhesive is filled in the space of the stepped end portion 22 rearward of the adjusting screw 36 so as to maintain the desired fluid-tightness. The diaphragm 21 is backed up by a diaphragm backing member 38, and another compression spring 39 is interposed between the diaphragm backing member 38 and the valve member 25 for normally pressing the valve member 25 against the atmosphere communication port 19.

The operation of the first embodiment of the present invention will now be described with reference to FIG. 1.

When the engine is rotating at an idling speed, the first vacuum bleed port 14 is located downstream relative to the throttle valve 2. In this position, the vacuum created in the intake passage 1 is transmitted through the vacuum bleed port 14 and vacuum delay transmitting valve 16 to the diaphragm chamber 12 in the throttle valve positioner diaphragm device 7, and the internal pressure of the diaphragm chamber 12 is lower than the atmospheric pressure. Therefore, the rod 8 is retracted toward the diaphragm chamber 12 against the force of the compression spring 13, and the throttle valve positioner does not exhibit the function of inhibiting the swinging movement of the throttle valve 2 toward the full closed position.

Then, when the accelerator pedal is depressed to open the throttle valve 2 for starting the vehicle, the first vacuum bleed port 14 is now located upstream relative to the throttle valve 2, and a pressure substantially equal to the atmospheric pressure is applied to the first vacuum bleed port 14.

Due to the fact that the internal pressure of the diaphragm chamber 12 is still lower than the atmospheric pressure at the moment the throttle valve 2 is opened, air flows into the diaphragm chamber 12 through the vacuum delay transmitting valve 16, and the internal pressure of the diaphragm chamber 12 is gradually increased until finally it becomes equal to the atmospheric pressure. At the same time, the rid 8 is advanced, and the throttle valve stopper 5 connected to the rod 8 is urged so that the throttle valve positioner can now be placed in operation, that is, the throttle valve positioner is now capable of inhibiting the swinging movement of the throttle valve 2 toward the full closed position. In this case, the rate of delay of vacuum transmission, that is, the gap of the orifice of the vacuum delay transmitting valve 16 may be suitably selected so that the throttle valve positioner can be continuously kept in the operating state until the gear position of the transmission is shifted to a higher speed position after starting.

When the vehicle is running at a steady speed, the first vacuum bleed port 14 is located is upstream relative to the throttle valve 2. Thus, in such position, a pressure substantially equal to the atmospheric pressure is applied to the first vacuum bleed port 14, and the throttle valve positioner is kept in the continuously operating state.

When, in this steady running state, the force imparted to the accelerator pedal is released to shift the gear position of the transmission, a vacuum is created in the intake passage 1 and may be applied to the first vacuum bleed port 14. However, due to the fact that the length of time required for shifting the gear position of the transmission is relatively short, the vacuum delay transmitting valve 16 does not respond, and the atmospheric pressure in the diaphragm chamber 12 in the throttle valve positioner diaphragm device 7 is maintained to hold the throttle valve positioner in the continuously operating state.

In the idling and steady running conditions except the transmission gear shifting condition at accelerating stage, the rotating speed of the engine is not so high, and therefore, the absolute value of the vacuum or negative pressure created in the intake passage 1 and transmitted to the diaphragm chamber 23 in the vacuum control valve 18 through the second vacuum bleed port 28 and conduit 29 is not so large. Accordingly, this vacuum is not so powerful as to urge the valve member 25 away from the atmosphere communication port 19 against the predetermined force of the compression spring 24, and the atmosphere communication port 19 is kept closed.

Consider now the case in which the vehicle is decelerated from the steady running state. When the absolute value of the vacuum created in the intake passage 1 in such a case is smaller than the predetermined setting of the compression spring 24 in the vacuum control valve 18, this vacuum is not effective in urging the diaphragm 21, hence the valve member 25, away from the atmosphere communication port 19, and the valve member 25 is held in the position in which it is pressed against the atmosphere communication port 19. Therefore, the vacuum created in the intake passage 1 is applied to the first vacuum bleed port 14 while the atmosphere communication port 19 of the vacuum control valve 18 is kept closed. As a result, the absolute value of the vacuum applied to the diaphragm chamber 12 in the throttle valve positioner diaphragm device 7 is gradually increased, and the rod 8 is gradually urged in the retracting direction by the diaphragm 11 against the force of the compression spring 13 until finally the throttle valve positioner is deenergized. Consequently, the throttle valve 2 tending to start to swing in the closing direction due to the release of the accelerator pedal actuating force swings gradually toward the full closed position.

When the absolute value of the vacuum created in the intake passage 1 during the deceleration is larger than the predetermined control setting of the vacuum control valve 18, this vacuum is effective in urging the diaphragm 21, hence the valve member 25, away from the atmosphere communication port 19. Therefore, air at the atmospheric pressure is admitted into the diaphragm chamber 12 in the throttle valve positioner diaphragm device 7 through the atmosphere communication opening 27, air filter 26, atmosphere communication port 19, and conduits 17 and 15. Due to the admission of the atmospheric pressure into the diaphragm chamber 12, the throttle valve positioner is placed in operation. With the reduction in the running speed of the vehicle, that is, the reduction in the rotating speed of the engine due to the decelerating effort, the absolute value of the vacuum created in the intake passage 1 becomes smaller than the predetermined control setting of the vacuum control valve 18, and the valve member 25 of the vacuum control valve 18 is urged to the port closing position. As a result, the vacuum created in the intake passage 1 is applied to the diaphragm chamber 12 in the throttle valve positioner diaphragm device 7 again to release the throttle valve positioner from the operating state. Consequently, the throttle valve 2 swings gradually toward the full closed position.

When the throttle valve 2 swings toward the full closed position as a result of the deenergization of the throttle valve positioner, the vacuum control valve 18 may start its control operation again due to the increase in the vacuum created in the intake passage 1, and thus, the throttle valve positioner may be repeatedly energized and deenergized. In this case too, such repeated operation can be carried out due to the fact that the link mechanism consisting of the throttle valve stopper 5 and rod 8 operates depending on the internal pressure of the diaphragm chamber 12 for energizing and deenergizing the throttle valve positioner independently of the depression of the accelerator pedal.

Figure 4:
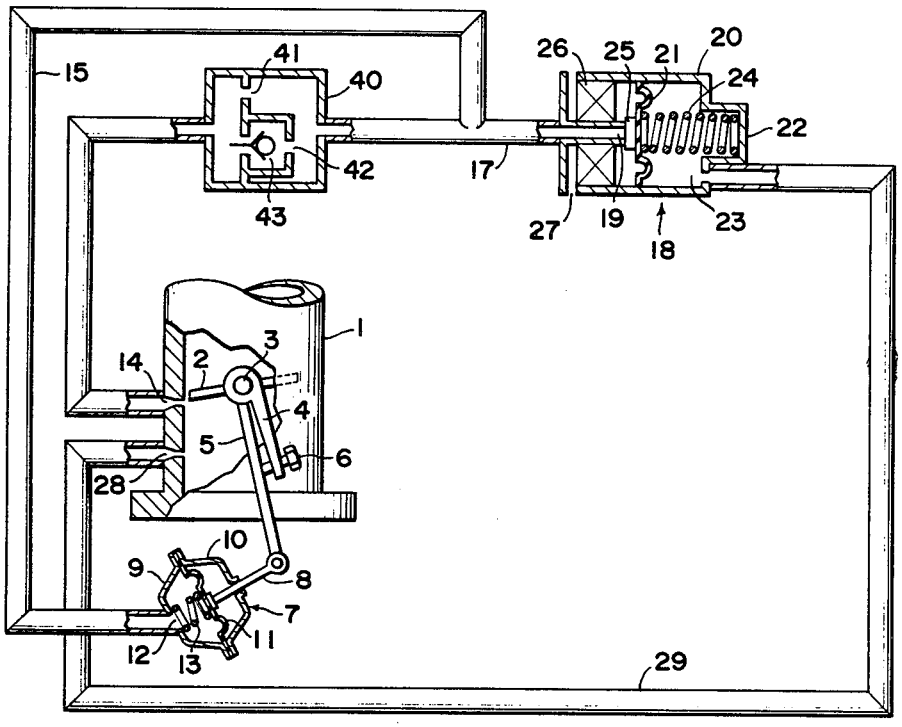
FIG. 4 is a partly sectional, schematic view showing the structure of another embodiment of the present invention.

FIG. 4 shows another embodiment of the present invention which is generally similar in structure to the first embodiment shown in FIG. 1 inasmuch as this second embodiment is a partial modification of the first embodiment.

Referring to FIG. 4, the vacuum delay transmitting valve 16 in FIG. 1 is replaced by a vacuum delay transmitting valve 40 of the type which provides different flow rates depending on the direction of flow. This vacuum delay transmitting valve 40 comprises a pair of orifices 41 and 42, and a check valve 43 disposed in series with the orifice 42. This check valve 43 permits only the flow of fluid from the first vacuum bleed port 14 to the diaphragm chamber 12 in the throttle valve positioner diaphragm device 7.

It is apparent that the second embodiment having such a structure operates in a manner entirely similar to the first embodiment so that the throttle valve positioner can be controlled depending on the vacuum created in the intake passage 1. Due to the employment of such vacuum delay transmitting valve 40, the flow rate of fluid from the first vacuum bleed port 14 toward the diaphragm chamber 12 is greater than that in the reverse direction. Thus, the rate of transmission of the atmospheric pressure toward the first vacuum bleed port 14 is less than the rate of transmission of the vacuum from the first vacuum bleed port 14 toward the diaphragm chamber 12. Therefore, the mixing ratio of fuel and air is subject to less change.

We claim:

1. A throttle valve positioner in combination with an internal combustion engine having an air intake and a throttle valve provided in said air intake, said throttle valve positioner comprising:

a stopper provided adjacent said throttle valve for varying the position of said throttle valve and coupled to said throttle valve via a first adjustment means;

a means for normally operating said throttle valve;

a first vacuum bleed port provided in said air intake at a point downstream from said throttle valve when said engine is idling and upstream from said throttle valve when said engine is running at a steady speed;

a throttle valve positioner diaphragm device mechanically coupled to said stopper for moving said stopper in response to a vacuum at said first vacuum bleed port, said diaphragm device comprising a casing having first and second ends and an opening in each of said ends, a diaphragm dividing said casing and defining a chamber between said first end and said diaphragm and a spring biasing said diaphragm away from said first end and wherein said opening in said first end is coupled to said first vacuum bleed port by a first conduit and wherein said stopper is mechanically connected to said diaphragm via said opening in said second end;

a means for delaying the response of said throttle valve positioner diaphragm device to a change in vacuum at said first vacuum bleed port provided in said first conduit, said delay means comprising a flow restricting means having such a structure that the flow rate of fluid from said first vacuum bleed port toward said diaphragm chamber is greater than that in the reverse direction and further comprises a pair of flow restricting means arranged in parallel with each other, and a check valve disposed in series with one of said flow restricting means, said check valve permitting solely the flow of fluid from said first vacuum bleed port toward said chamber of said diaphragm device;

a second vacuum bleed port provided in said air intake at a point which is always downstream of said throttle valve; and a vacuum control valve for fixing the vacuum of said first vacuum bleed port at atmospheric pressure whenever a vacuum at said second vacuum bleed port is greater than a predetermined value, said vacuum control valve comprising:

a casing having an open end communicating with the atmosphere;

a diaphragm provided within said casing with the outer periphery thereof brought into fluid-tight engagement with the inner wall of said casing and defining a chamber therein;

a branch conduit extending at one end thereof into said open end of said casing and connected at the other end thereof to said chamber of said throttle valve positioner diaphragm device;

a valve member mounted to said diaphragm for openably closing said end of said branch conduit extending into said casing;

biasing means for normally biasing said diaphragm in a direction in which said end of said branch conduit extending into said casing is closed by said valve member, said biasing means being disposed between said diaphragm and said casing, and the biasing pressure thereof being adjusted as desired by adjustment means, said adjustment means comprising a screw in screw threaded engagement with said casing;

a filler provided in the space formed between the rear end of said screw and said casing for inhibiting inflow of positive pressure into said vacuum control valve diaphragm chamber through the screw threads; and another conduit for admitting the vacuum at said second vacuum bleed port into said vacuum control valve diaphragm chamber.

2. A throttle valve positioner in combination with an internal combustion engine having an air intake and a throttle valve provided in said air intake, said throttle valve positioner comprising:

a stopper provided adjacent and abutting said throttle valve for varying the position of said throttle valve;

a means for normally operating said throttle valve;

a first vacuum bleed port provided in said air intake at a point downstream from said throttle valve when said engine is idling and upstream from said throttle valve when said engine is running at a steady speed;

a throttle valve positioner diaphragm device mechanically coupled to said stopper for moving said stopper in response to a vacuum at said first vacuum bleed port, said diaphragm device comprising a casing having first and second ends and an opening in each of said ends, a diaphragm dividing said casing and defining a chamber between said first end and said diaphragm and a spring biasing said diaphragm away from said first end and wherein said opening in said first end is coupled to said first vacuum bleed port by a first conduit and wherein said stopper is coupled to said diaphragm via said opening in said second end;

a means for delaying the response of said throttle valve positioner diaphragm device to a change in vacuum at said first vacuum bleed port provided in said first conduit, said delay means comprising a flow restricting means having such a structure that the flow rate of fluid from said first vacuum bleed port toward said diaphragm chamber is greater than that in the reverse direction;

a second vacuum bleed port provided in said air intake at a point which is always downstream of said throttle valve; and a vacuum control valve for fixing the vacuum of said first vacuum bleed port at atmospheric pressure whenever a vacuum at said second vacuum bleed port is greater than a predetermined value, said vacuum control valve comprising:

a casing having an open end communicating with the atmosphere;

a diaphragm provided within said casing with the outer periphery thereof brought into fluid-tight engagement with the inner wall of said casing;

a branch conduit extending at one end thereof into said open end of said casing and connected at the other end thereof to said chamber of said throttle valve positioner diaphragm device;

a valve member mounted to said diaphragm for openably closing said end of said branch conduit extending into said casing;

a means for normally biasing said diaphragm in a direction in which said end of said branch conduit extending into said casing is closed by said valve member; and another conduit for admitting the vacuum created at said second vacuum bleed port in said intake into a diaghragm chamber defined by said vaccuum control valve casing and said diaphragm.

* * * * *